US011365360B2

(12) United States Patent
Xu et al.

(10) Patent No.: US 11,365,360 B2
(45) Date of Patent: Jun. 21, 2022

(54) PROCESS FOR CONVERTING INFERIOR FEEDSTOCK OIL

(71) Applicants: CHINA PETROLEUM & CHEMICAL CORPORATION, Beijing (CN); RESEARCH INSTITUTE OF PETROLEUM PROCESSING, SINOPEC, Beijing (CN)

(72) Inventors: Youhao Xu, Beijing (CN); Tao Liu, Beijing (CN); Xin Wang, Beijing (CN); Lishun Dai, Beijing (CN); Tian Lan, Beijing (CN); Hong Nie, Beijing (CN); Dadong Li, Beijing (CN)

(73) Assignees: CHINA PETROLEUM & CHEMICAL CORPORATION, Beijing (CN); RESEARCH INSTITUTE OF PETROLEUM PROCESSING, SINOPEC, Beijing (CN)

( * ) Notice: Subject to any disclaimer, the term of this patent is extended or adjusted under 35 U.S.C. 154(b) by 0 days.

(21) Appl. No.: 15/768,437

(22) PCT Filed: Oct. 17, 2016

(86) PCT No.: PCT/CN2016/000577
§ 371 (c)(1),
(2) Date: Apr. 16, 2018

(87) PCT Pub. No.: WO2017/063309
PCT Pub. Date: Apr. 20, 2017

(65) Prior Publication Data

US 2019/0225897 A1 Jul. 25, 2019

(30) Foreign Application Priority Data

Oct. 15, 2015 (CN) ..... 201510671952.0
Oct. 15, 2015 (CN) ..... 201510672058.5

(51) Int. Cl.
*C10G 69/00* (2006.01)
*C10G 69/04* (2006.01)
(Continued)

(52) U.S. Cl.
CPC ..... *C10G 69/04* (2013.01); *C10G 47/02* (2013.01); *C10G 65/10* (2013.01);
(Continued)

(58) Field of Classification Search
CPC ..... C10G 11/18; C10G 69/00; C10G 69/02; C10G 69/04; C10G 2300/4018;
(Continued)

(56) References Cited

U.S. PATENT DOCUMENTS 3,203,889 A 8/1965 Pollitzer et al.
4,381,987 A * 5/1983 Kuehler ..... C10G 1/083 208/419
(Continued)

FOREIGN PATENT DOCUMENTS

CN 1382776 A 12/2002
CN 101210200 B 10/2010
(Continued)

*Primary Examiner* — Prem C Singh
*Assistant Examiner* — Brandi M Doyle
(74) *Attorney, Agent, or Firm* — Novick, Kim & Lee, PLLC; Allen Xue

(57) ABSTRACT

A process for converting inferior feedstock oil includes several steps. In step a) the inferior feedstock oil is subjected to a low severity hydrogenation reaction. The reaction product is separated to produce a gas, a hydrogenated naphtha, a hydrogenated diesel and a hydrogenated residual oil. In step b) the hydrogenated residual oil obtained in step a) is subjected to a first catalytic cracking reaction, the reaction product is separated to produce a first dry gas, a first LPG, a first gasoline, a first diesel and a first FCC-gas oil. In step c) the first FCC-gas oil obtained in step b) is
(Continued)

subjected to a hydrogenation reaction of gas oil, the reaction product is separated to produce a hydrogenated gas oil, and in step d) the hydrogenated gas oil obtained in step c) is subjected to the first catalytic cracking reaction of step b) or a second catalytic cracking reaction.

19 Claims, 1 Drawing Sheet

(51) Int. Cl.
*C10G 65/10* (2006.01)
*C10G 47/02* (2006.01)

(52) U.S. Cl.
CPC ..... *C10G 2300/107* (2013.01); *C10G 2300/1077* (2013.01); *C10G 2300/205* (2013.01); *C10G 2400/02* (2013.01); *C10G 2400/04* (2013.01); *C10G 2400/26* (2013.01)

(58) Field of Classification Search
CPC .... C10G 2300/4025; C10G 2300/1033; C10G 2300/104; C10G 2300/1044; C10G 2300/1055; C10G 2300/107; C10G 2300/1077; C10G 2300/203; C10G 2300/205; C10G 2300/308; C10G 2300/4093; C10G 2300/44; C10G 2400/02; C10G 2400/04; C10G 2400/06; C10G 2400/26; C10G 2400/28
See application file for complete search history.

(56) References Cited

U.S. PATENT DOCUMENTS

| | | | | |
|---|---|---|---|---|
| 4,713,221 | A | 12/1987 | Montgomery et al. | |
| 4,780,193 | A * | 10/1988 | Derr, Jr. ..... | C10G 69/04 208/144 |
| 5,108,581 | A * | 4/1992 | Aldridge ..... | C10G 1/086 208/108 |
| 2011/0000818 | A1* | 1/2011 | Xu ..... | C10G 11/18 208/70 |

FOREIGN PATENT DOCUMENTS

| | | | |
|---|---|---|---|
| CN | 102344829 | A | 2/2012 |
| CN | 102719272 | A | 10/2012 |

* cited by examiner

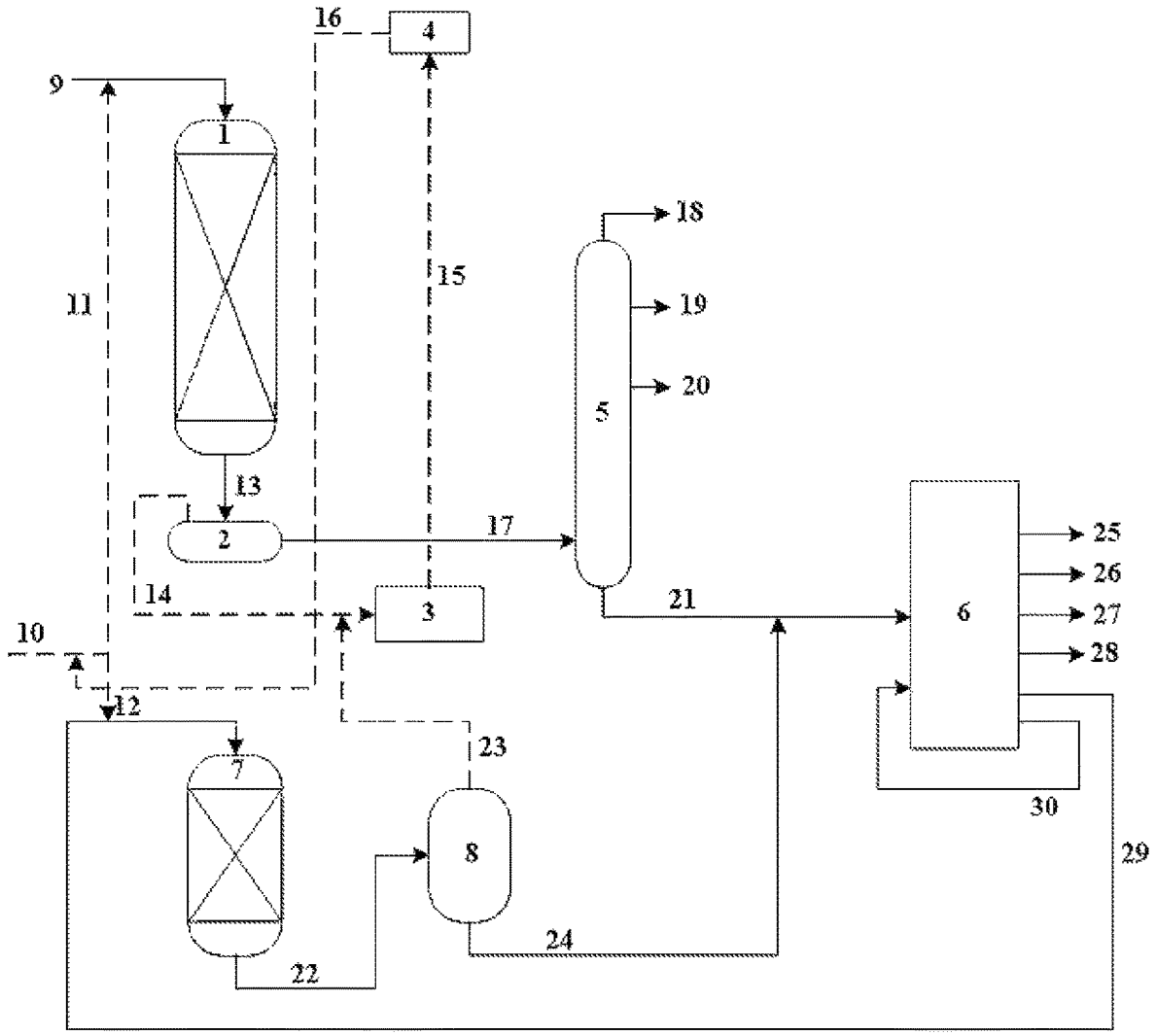
16
4
9
1
11
15
18
19
20
5
13
2
17
25
26
27
28
14
3
21
6
10
12
23
7
8
30
29
24
22

PROCESS FOR CONVERTING INFERIOR FEEDSTOCK OIL

FIELD OF THE INVENTION

The present invention relates to a process for converting inferior feedstock oil.

BACKGROUND OF THE INVENTION

CN101210200B discloses a combination of residual oil hydrogenation and catalytic cracking. Residual oil, FCC heavy cycle oil with solid impurities being removed, optionally fractioned oils and optionally FCC slurry distillate are together sent to a residual oil hydrogenation unit, the resultant hydrogenated residual oil and optionally vacuum gas oil are sent to a FCC unit to produce various products; the FCC heavy cycle oil, after removing the solid impurities, can be recycled to the residual oil hydrogenation unit; the FCC slurry is subjected to distillation and the resultant distillate can be recycled to the residual oil hydrogenation unit.

CN102344829A discloses a combination of residual oil hydrogenation, FCC heavy oil hydrogenation and catalytic cracking. The liquid stream obtained from the residual oil hydrogenation reactor is distillated to produce residual oil hydrogenation tail oil, which is sent as FCC feedstock to the FCC unit. The FCC heavy oil separated from the FCC products and the gas stream obtained from the residual oil hydrogenation reactor are mixed and sent to the FCC heavy oil hydrogenation reactor. The hydrogenated FCC heavy oil is recycled to the FCC unit.

There is still a need for the new converting process of inferior feedstock oil, which process can increase the run length of hydrotreating unit, reduce the chemical hydrogen consumption, and increase the liquid product yield.

SUMMARY OF THE INVENTION

The object of the present invention is to provide a new converting process for inferior feedstock oil, the process can increase the run length of the hydrotreating unit, and have low chemical hydrogen consumption and high liquid product yield.

The present invention provides a process for converting inferior feedstock oil, wherein said process comprises:

a) the inferior feedstock oil is subjected to a low severity hydrogenation reaction, the resultant reaction product is separated to produce a gas, a hydrogenated naphtha, a hydrogenated diesel and a hydrogenated residual oil; wherein, in the low severity hydrogenation reaction, based on the inferior feedstock oil, the yield of the hydrogenated residual oil is 85%-95% by weight, the property of the hydrogenated residual oil is substantially kept at a constant level;

b) the hydrogenated residual oil obtained in step a) is subjected to a first catalytic cracking reaction, the resultant reaction product is separated to produce a first dry gas, a first LPG a first gasoline, a first diesel and a first FCC-gas oil (FGO);

c) the first FGO obtained in step b) is subjected to a hydrogenation reaction of gas oil, the resultant reaction product is separated to produce a hydrogenated gas oil;

d) the hydrogenated gas oil obtained in step c) is subjected to the first catalytic cracking reaction of step b) or a second catalytic cracking reaction.

In an embodiment, wherein the process further comprises step e): a second FCC gas oil obtained in the second catalytic cracking reaction of step d) is subjected to the hydrogenation reaction of gas oil of step c).

In an embodiment, in the low severity hydrogenation reaction of step a), based on the inferior feedstock oil, the yield of the hydrogenated residual oil is 87%-93% by weight, the property of the hydrogenated residual oil is substantially kept at a constant level.

If the property of the hydrogenated residual oil is changed in an undesirable manner (for example, the density increases or the carbon residue content increases), the severity of the hydrogenation reaction is increased so that the property of the hydrogenated residual oil is substantially kept at the same constant level as the property of the hydrogenated residual oil at the early stage (for example, 0-1000 hrs). For example, when the increasing rate for the density of the hydrogenated residual oil is above 0.005 $g/cm^3$/(1000 hrs), and/or when the increasing rate for the carbon residue content of the hydrogenated residual oil is above 0.5 wt %/(1000 hrs), the severity of the hydrogenation reaction is increased (for example, the reaction temperature is increased at 2-10° C./(1000 hrs) or the liquid hourly space velocity (LHSV) is decreased at 0.1-0.5 $h^{-1}$/(1000 hrs)).

In an embodiment, in step a), the sulfur removal rate for the inferior feedstock oil is 50-95 wt %, the nitrogen removal rate is 10-70 wt %, the carbon residue removal rate is 10-70 wt %, and the metal removal rate is 50-95 wt %.

In an embodiment, the reaction conditions of the low severity hydrogenation reaction includes: the hydrogen partial pressure is 8-20 MPa, the reaction temperature is 330-420° C., the liquid hourly space velocity is 0.1-1.5 $h^{-1}$, and the total hydrogen/oil volume ratio is 200-1500 normal $m^3/m^3$.

In an embodiment, the reaction temperature in the early stage of the low severity hydrogenation reaction (for example, 0-1000 hrs) is 350-370° C., for example, 350-360° C., 350-355° C., or for example, 350° C., 351° C., 352° C., 353° C., 354° C., 355° C., 356° C., 357° C., 358° C., 359° C., 360° C., 361° C., 362° C., 363° C., 364° C., 365° C., 366° C., 367° C., 368° C., 369° C. or 370° C.

In an embodiment, the low severity hydrogenation reaction is conducted in a fixed bed reactor in presence of a hydrogenation catalyst. According to the function of the hydrogenation catalyst, in the flow direction of reactants, the hydrogenation catalyst for the low severity hydrogenation reaction can successively comprise a hydrogenation protecting catalyst, a hydrodemetallization catalyst, a hydrodesulfurization catalyst, and a hydrodenitrogenation and carbon residue removing catalyst. Preferably, based on the total weight of the hydrogenation catalyst, the hydrogenation protecting catalyst and the hydrodemetallization catalyst comprise 20%-70%, for example, 30%-50%; the hydrodesulfurization catalyst comprises 20%-70%, for example, 40%-60%; the hydrodenitrogenation and carbon residue removing catalyst comprises 0%-60%, for example, 10%-40%, and the total of the hydrogenation protecting catalyst, the hydrodemetallization catalyst, the hydrodesulfurization catalyst, and the hydrodenitrogenation and carbon residue removing catalyst is 100 wt %. The hydrogenation catalysts are those conventionally used in the art. In a preferable embodiment, based on the total weight of the hydrogenation catalyst, the hydrodemetallization catalyst comprises 30 wt % or higher.

In an embodiment, the inferior feedstock oil is petroleum hydrocarbons and/or other mineral oils, wherein the petroleum hydrocarbon is selected from atmospheric gas oil, vacuum gas oil, atmospheric residual oil, vacuum residual oil, hydrogenated residual oil, coker gas oil, deasphalted oil, and any combination thereof, and the other mineral oil is selected from liquefied oil derived from coal or natural gas, tar sand oil, tight oil, shale oil, and any combination thereof.

In an embodiment, the inferior feedstock oil satisfies: (1) the density at 20° C. is 910-1000 kg/m$^3$; and/or (2) the weight percent of carbon residue is 4-15 wt %; and/or (3) the content of metals (Ni+V) is 12-600 ppm. In a preferable embodiment, the inferior feedstock oil satisfies: (1) the density at 20° C. is 980-1000 kg/m$^3$; and/or (2) the weight percent of carbon residue is 10-15 wt %; and/or (3) the content of metals (Ni+V) is 60-600 ppm.

In an embodiment, the first catalytic cracking reaction comprises the following steps: (1) a preheated hydrogenated residual oil and a first regenerated catalytic cracking catalyst are subjected to a first cracking reaction in the lower part of the first catalytic cracking reactor, the resultant reaction product is separated to produce a first cracking product and a first semi-regenerated catalytic cracking catalyst; the micro-activity of the first regenerated catalytic cracking catalyst is 35-60; (2) the first cracking product and the first semi-regenerated catalytic cracking catalyst obtained in step (1) are then subjected to a first further catalytic conversion reaction in the upper part of the first catalytic cracking reactor, and the resultant reaction product is separated by fractionation to produce the first dry gas, the first LPG the first gasoline, the first diesel and the first FCC-gas oil. The upper and lower parts of the first catalytic cracking reactor are demarcated by a certain position between the first ⅓ part and the first ⅔ part of the reactor (in the flowing direction of reactants). In a preferable embodiment, the lower part refers to the first half of the reactor length, while the upper part refers to the second half of the reactor length.

In an embodiment, the first cracking reaction is conducted in the following conditions: the reaction temperature is 530-620° C., the weight hourly space velocity is 30-180 the catalyst/oil ratio is 4-12, the steam/oil ratio is 0.03-0.3, the reaction pressure is 130 kPa-450 kPa; the first further catalytic conversion reaction is conducted in the following conditions: the reaction temperature is 460° C.-520° C., the weight hourly space velocity is 20-100 h$^{-1}$, the catalyst/oil ratio is 3-15, the steam/oil ratio is 0.03-0.3, the reaction pressure is 130 kPa-450 kPa.

In an embodiment, in the first catalytic cracking reaction, the hydrogen content of the first FGO is 10.5-15 wt %; based on the hydrogenated residual oil, the yield of the first FGO is 15-50 wt %.

In an embodiment, a second-processed gas oil and the first FGO are together subjected to the hydrogenation reaction of gas oil; the second-processed gas oil is selected from the group consisting of coker gas oil, deasphalted oil, FGO produced by other FCC units, and any combination thereof.

In an embodiment, the hydrogenation reaction of gas oil is conducted in a fixed bed reactor in presence of a hydrogenation catalyst. According to the function of the hydrogenation catalyst, in the flow direction of reactants, the hydrogenation catalyst for the hydrogenation reaction of gas oil can successively comprise a hydrogenation protecting catalyst, a hydrodemetallization and hydrodesulfurization catalyst and a hydrotreatment catalyst. Preferably, based on the total weight of the hydrogenation catalyst, the hydrogenation protecting catalyst comprises 0-30 wt %, for example, 5-20 wt %, the hydrodemetallization and hydrodesulfurization catalyst comprises 5-35 wt %, for example, 10-25 wt %; and the hydrotreatment catalyst comprises 35%-95 wt %, for example, 55-85 wt %, and the total of the hydrogenation protecting catalyst, the hydrodemetallization and hydrodesulfurization catalyst and the hydrotreatment catalyst is 100 wt %. The hydrogenation catalysts are those conventionally used in the art.

In an embodiment, the hydrogenation reaction of gas oil is conducted in the following conditions: the reaction pressure is 5.0-20.0 MPa, the reaction temperature is 300-430° C., the liquid hourly space velocity is 0.2-5.0 h$^{-1}$, and the hydrogen/oil volume ratio is 200-1800 normal m$^3$/m$^3$.

In an embodiment, the second catalytic cracking reaction is conducted in the following conditions: the reaction temperature is 450° C.-620° C., the weight hourly space velocity is 1-100 the catalyst/oil ratio is 1-25, and the steam/oil ratio is 0.03-0.3.

In an embodiment, the second catalytic cracking reaction comprises the following steps: (1) a preheated hydrogenated gas oil and a second regenerated catalytic cracking catalyst are subjected to a second cracking reaction in the lower part of a second catalytic cracking reactor, the resultant reaction product is separated to produce a second cracking product and a second semi-regenerated catalytic cracking catalyst; (2) the second cracking product obtained in step (1) and the second semi-regenerated catalytic cracking catalyst are then subjected to a second further catalytic conversion reaction in the upper part of the second catalytic cracking reactor, and the resultant reaction product is separated by fractionation to produce a second dry gas, a second LPG a second gasoline, a second diesel and a second FCC gas oil. The upper and lower parts of the second catalytic cracking reactor are demarcated by a certain position between the first ⅓ part and the first ⅔ part of the reactor (in the flowing direction of reactants). In a preferable embodiment, the lower part refers to the first half of the reactor length, while the upper part refers to the second half of the reactor length.

In an embodiment, the second cracking reaction is conducted in the following conditions: the reaction temperature is 530-620° C., the weight hourly space velocity is 30-180 the catalyst/oil ratio is 4-12, the steam/oil ratio is 0.03-0.3, the reaction pressure is 130 kPa-450 kPa; the second further catalytic conversion reaction is conducted in the following conditions: the reaction temperature is 460° C.–520° C., the weight hourly space velocity is 20-100 the catalyst/oil ratio is 3-15, the steam/oil ratio is 0.03-0.3, the reaction pressure is 130 kPa-450 kPa.

The present invention also provides the following technical solutions:

Solution 1: A treatment process for converting a heavy feedstock oil, wherein said process comprises:

a) the heavy feedstock oil is subjected to a low severity hydrogenation reaction, the resultant reaction product is separated to produce a hydrogenated gas, a hydrogenated naphtha, a hydrogenated diesel and a hydrogenated residual oil; wherein, based on the heavy feedstock oil, the yield of the hydrogenated residual oil is controlled to 85%-95% by weight;

b) the hydrogenated residual oil obtained in step a) and a FCC catalyst are subjected to a first catalytic cracking reaction to produce a first dry gas, a first LPG a first gasoline, a first light cycle oil, a first FCC gas oil and a slurry oil to be separated off; wherein the micro-activity of the FCC catalyst is 40-55;

c) the first FGO obtained in step b), after filtration, is subjected to a hydrogenation reaction of gas oil to produce a hydrogenated gas oil; the slurry oil to be separated off obtained in step b) is subjected to the first catalytic cracking reaction of step b);

d) the hydrogenated gas oil obtained in step c) is subjected to a second catalytic cracking reaction or the first catalytic cracking reaction.

Solution 2: The process according to Solution 1, wherein the process further comprises step e): a second FGO obtained from the second catalytic cracking reaction in step d) is subjected to the hydrogenation reaction of gas oil of step c).

Solution 3: The process according to Solution 1, wherein, in step a), based on the heavy feedstock oil, the yield of the hydrogenated residual oil is controlled to 87-93 wt %.

Solution 4: The process according to Solution 1, wherein, in step a), the sulfur removal rate of the heavy feedstock oil is controlled to 50-95 wt %, the nitrogen removal rate is controlled to 20-70 wt %, the carbon residue removal rate is controlled to 20-70 wt %, and the metal removal rate is controlled to 50-90 wt %.

Solution 5: The process according to Solution 1, wherein the conditions of the low severity hydrogenation reaction comprise: the hydrogen partial pressure is 10-20 MPa, the reaction temperature is 320-420° C., the liquid hourly space velocity is 0.2-1.0 $h^{-1}$, and the total hydrogen/oil volume ratio is 300-1500 normal $m^3/m^3$.

Solution 6: The process according to Solution 1, wherein the heavy feedstock oil is petroleum hydrocarbons and/or other mineral oils, wherein the petroleum hydrocarbon is at least one selected from atmospheric gas oil, vacuum gas oil, atmospheric residual oil, vacuum residual oil, hydrogenated residual oil, coker gas oil and deasphalted oil, and the other mineral oil is at least one selected from liquefied oil derived from coal or natural gas, tar sand oil, tight oil and shale oil.

Solution 7: The process according to Solution 1, wherein the heavy feedstock oil satisfies: the density at 20° C. is 910-1000 $kg/m^3$ and/or the weight percent of carbon residue is 4-15 wt % and/or the metal content is 12-600 ppm.

Solution 8: The process according to Solution 1, wherein, the first catalytic cracking reaction condition in step b) comprises: the reaction temperature is 450-670° C., the weight hourly space velocity is 10-100 $h^{-1}$, the weight ratio of the regenerated catalyst to the feedstock oil is 1-30, the weight ratio of the water vapor (steam) to the feedstock is 0.03-1.0.

Solution 9: The process according to Solution 1, wherein, the first FGO is controlled to have a hydrogen content of 9.0-13.0 wt %; based on the hydrogenated residual oil of step b), the yield of the first FGO is controlled to 15%-50% by weight.

Solution 10: The process according to Solution 1, wherein, the slurry oil to be separated off obtained in step b) has a solid content of <6 g/L and a density at 20° C. of 920-1150 $kg/m^3$.

Solution 11: The process according to Solution 1, wherein the first FGO in step c), after filtration, has a solid content of <10 ppm.

Solution 12: The process according to Solution 1, wherein a second-processed gas oil and the first FGO are together subjected to the hydrogenation reaction of gas oil of step c); the second-processed gas oil is at least one selected from coker gas oil, deasphalted oil and FGO produced by other FCC units.

Solution 13: The process according to Solution 1, wherein the hydrogenation reaction of gas oil of step c) is conducted in a fixed bed reactor; in the direction of reactants, a hydrogenation protecting catalyst, a hydrodemetallization and hydrodesulfurization catalyst and a hydrotreatment catalyst are successively loaded in the fixed bed reactor.

Solution 14: The process according to Solution 1, wherein, the conditions for the hydrogenation reaction of gas oil of step c) comprise: the reaction pressure is 6.0-18.0 MPa, the reaction temperature is 270-420° C., the liquid hourly space velocity is 0.2-1.0 $h^{-1}$, and the hydrogen/oil volume ratio is 200-1800 normal $m^3/m^3$.

Solution 15: The process according to Solution 1, wherein, the conditions for the second catalytic cracking reaction of step d) comprise: the reaction temperature is 450° C.-620° C., the weight hourly space velocity is 1-100 $h^{-1}$, the catalyst/oil ratio is 1-25, and the steam/oil ratio is 0.03-0.3.

Solution 16: A process for converting inferior feedstock oil, wherein said process comprises:

a) the inferior feedstock oil is subjected to low severity hydrogenation reaction, to produce a gas, a hydrogenated naphtha, a hydrogenated diesel and a hydrogenated residual oil; wherein based on the inferior feedstock oil, the yield of the hydrogenated residual oil is controlled to 85-95 wt %;

b) the hydrogenated residual oil obtained in step a) is subjected to a first catalytic cracking reaction to produce a first dry gas, a first LPG a first gasoline, a first diesel and a first FGO;

c) the first FGO obtained in step b) is subjected to a hydrogenation reaction of gas oil to produce a hydrogenated gas oil;

d) the hydrogenated gas oil obtained in step c) is subjected to a second catalytic cracking reaction to produce a second dry gas, a second LPG a second gasoline, a second diesel and a second FGO.

Solution 17: The process of Solution 16, wherein the process further comprises step e): the second FGO obtained in step d) is subjected to the hydrogenation reaction of gas oil of step c).

Solution 18: The process of Solution 16, wherein, in step a), based on the inferior feedstock oil, the yield of the hydrogenated residual oil is controlled to 87-93 wt %.

Solution 19: The process of Solution 16, wherein, in step a), the sulfur removal rate of the inferior feedstock oil is controlled to 50-95 wt %, the nitrogen removal rate is controlled to 10-70 wt %, the carbon residue removal rate is controlled to 10-70 wt %, and the metal removal rate is controlled to 50-95 wt %.

Solution 20: The process of Solution 16, wherein the conditions of the low severity hydrogenation reaction comprise: the hydrogen partial pressure is 8-20 MPa, the reaction temperature is 330-420° C., the liquid hourly space velocity is 0.1-1.5 $h^{-1}$, and the total hydrogen/oil volume ratio is 200-1500 normal $m^3/m^3$.

Solution 21: The process of Solution 16, wherein the inferior feedstock oil is petroleum hydrocarbons and/or other mineral oils, wherein the petroleum hydrocarbon is at least one selected from atmospheric gas oil, vacuum gas oil, atmospheric residual oil, vacuum residual oil, hydrogenated residual oil, coker gas oil and deasphalted oil, and the other mineral oil is at least one selected from liquefied oil derived from coal or natural gas, tar sand oil, tight oil and shale oil.

Solution 22: The process of Solution 16, wherein the inferior feedstock oil satisfies: the density at 20° C. is 920-1100 $kg/m^3$, and the weight percent of carbon residue is 8-20 wt %.

Solution 23: The process of Solution 16, wherein the hydrogenated residual oil obtained in step a) is subjected to a first catalytic cracking reaction, comprising the following steps:

(1) a preheated hydrogenated residual oil and a first regenerated catalytic cracking catalyst are subjected to a first cracking reaction in the lower part of the first catalytic cracking reactor, the resultant reaction product is separated to produce a first cracking product and a first semi-regenerated catalytic cracking catalyst;

(2) the first cracking product and the first semi-regenerated catalytic cracking catalyst obtained in step (1) are then subjected to a first further catalytic conversion reaction in the upper part of the first catalytic cracking reactor, and the resultant reaction product is separated by fractionation to produce the first dry gas, the first LPG; the first gasoline, the first diesel and the first FGO.

Solution 24: The process of Solution 23, wherein the condition of the first cracking reaction of step (1) comprises: the reaction temperature is 530-620° C., the weight hourly space velocity is 30-180 $h^{-1}$, the catalyst/oil ratio is 4-12, the steam/oil ratio is 0.03-0.3, and the reaction pressure is 130 kPa-450 kPa; and the condition of the first further catalytic conversion reaction of step (2) comprises: the reaction temperature is 460° C.-520° C., the weight hourly space velocity is 20-100 the catalyst/oil ratio is 3-15, the steam/oil ratio is 0.03-0.3, and the reaction pressure is 130 kPa-450 kPa.

Solution 25: The process of Solution 16, wherein the first FGO is controlled to have a hydrogen content of 10.5-15 wt %; based on the hydrogenated residual oil of step b), and the yield of the first FGO is controlled to 15%-50% by weight.

Solution 26: The process of Solution 16, wherein a second-processed gas oil and the first FGO are together subjected to the hydrogenation reaction of gas oil of step c); the second-processed gas oil is at least one selected from coker gas oil, deasphalted oil and FGO produced by other FCC units.

Solution 27: The process of Solution 16, wherein the hydrogenation reaction of gas oil of step c) is conducted in a fixed bed reactor; in the direction of reactants, a hydrogenation protecting catalyst, a hydrodemetallization and hydrodesulfurization catalyst and a hydrotreatment catalyst are successively loaded in the fixed bed reactor.

Solution 28: The process of Solution 16, wherein the condition of the hydrogenation reaction of gas oil of step c) comprises: the reaction pressure is 5.0-20.0 MPa, the reaction temperature is 300-430° C., the liquid hourly space velocity is 0.2-5.0 $h^{-1}$, and the hydrogen/oil volume ratio is 200-1800 normal $m^3/m^3$.

Solution 29: The process of Solution 16, wherein the condition of the second catalytic cracking reaction of step d) comprises: the reaction temperature is 450° C.–620° C., the weight hourly space velocity is 1-100 $h^{-1}$, the catalyst/oil ratio is 1-25, and the steam/oil ratio is 0.03-0.3.

Solution 30: The process of Solution 16, wherein the hydrogenated gas oil obtained in step c) is subjected to a second catalytic cracking reaction, comprising the following steps:

(α) a preheated hydrogenated gas oil and a second regenerated catalytic cracking catalyst are subjected to a second cracking reaction in the lower part of a second catalytic cracking reactor, the resultant reaction product is separated to produce a second cracking product and a second semi-regenerated catalytic cracking catalyst;

(β) the second cracking product obtained in step (α) and the second semi-regenerated catalytic cracking catalyst are then subjected to a second further catalytic conversion reaction in the upper part of the second catalytic cracking reactor, and the resultant reaction product is separated by fractionation to produce a second dry gas, a second LPG a second gasoline, a second diesel and a second FGO.

Solution 31: The process of Solution 30, wherein the condition of the second cracking reaction of step (α) comprises: the reaction temperature is 530-620° C., the weight hourly space velocity is 30-180 $h^{-1}$, the catalyst/oil ratio is 4-12, the steam/oil ratio is 0.03-0.3, and the reaction pressure is 130 kPa-450 kPa; and the condition of the second further catalytic conversion reaction of step (β) comprises: the reaction temperature is 460° C.-520° C., the weight hourly space velocity is 20-100 the catalyst/oil ratio is 3-15, the steam/oil ratio is 0.03-0.3, and the reaction pressure is 130 kPa-450 kPa.

The present invention further comprises any possible combination of the above embodiments and/or technical solutions.

By reducing the severity of the hydrogenation reaction of the inferior feedstock oil and controlling the conversion depth of the hydrogenated residual oil in the FCC unit, the present invention can extend the life of the hydrogenation catalyst, remarkably increase the operation period of the hydrogenation unit, and reduce the chemical hydrogen consumption. The other features and advantages of the present invention will be explained in details in the following detailed description.

DESCRIPTION OF DRAWINGS

The accompanying drawing is intended to provide a further understanding of the present invention and constitutes a part of the description and together with the following detailed description, serves to explain the present invention, but does not constitute a limitation of the present invention. In the drawing:

FIG. 1 is a schematic flow diagram of the process for converting the inferior feedstock oil of the present invention, in which

1 Low severity hydrogenation reactor
2 Separation unit of the low severity hydrogenation reaction product
3 Recycle gas treatment system
4 Recycled hydrogen compressor
5 Hydrogenation fractionation unit
6 First catalytic cracking reactor
7 Hydrogenation reactor of gas oil
8 Separation unit of the FGO hydrogenation product
9-30 Pipeline

DETAILED DESCRIPTION OF THE EMBODIMENTS

The specific embodiments of the present invention will be described in detail below with reference to the accompanying drawings. It should be understood that the specific embodiments described herein are only used to illustrate and explain the present invention and are not intended to limit the present invention.

The present invention provides a process for converting inferior feedstock oil, wherein said process comprises: a) the inferior feedstock oil is subjected to a low severity hydrogenation reaction, the resultant reaction product is separated to produce a gas, a hydrogenated naphtha, a hydrogenated diesel and a hydrogenated residual oil; wherein, in the low severity hydrogenation reaction, based on the inferior feedstock oil, the yield of the hydrogenated residual oil is 85%-95% by weight, preferably 87%-93% by weight, the property of the hydrogenated residual oil is substantially kept at a constant level; b) the hydrogenated residual oil obtained in step a) is subjected to a first catalytic cracking reaction, the resultant reaction product is separated to produce a first dry gas, a first LPG a first gasoline, a first diesel and a first FGO; c) the first FGO obtained in step b) is subjected to a hydrogenation reaction of gas oil, the resultant reaction product is separated to produce a hydrogenated gas oil; d) the hydrogenated gas oil obtained in step c) is subjected to the first catalytic cracking reaction of step b) or a second catalytic cracking reaction.

The process of the present invention can further comprise step e): a second FGO obtained in the second catalytic cracking reaction of step d) is subjected to the hydrogenation reaction of gas oil of step c).

According to the present invention, in the low severity hydrogenation reaction of step a), based on the inferior feedstock oil, the yield of the hydrogenated residual oil is 85%-95% by weight, preferably 87%-93% by weight, the property of the hydrogenated residual oil is substantially kept at a constant level. In the low severity hydrogenation reaction, "the property of the hydrogenated residual oil being substantially kept at a constant level" refers to satisfy at least one of the following requirements:

(1) the variation percent of the sulfur removal rate of the inferior feedstock oil (Δsulfur removal rate) is less than 20%;

(2) the variation percent of the nitrogen removal rate of the inferior feedstock oil (Δnitrogen removal rate) is less than 40%;

(3) the variation percent of the carbon residue removal rate of the inferior feedstock oil (Δcarbon residue removal rate) is less than 40%;

(4) the variation percent of the metal removal rate of the inferior feedstock oil (Δmetal removal rate) is less than 20%;

wherein

Δsulfur removal rate=[(max. sulfur removal rate−min. sulfur removal rate)/min. sulfur removal rate]*100%;

Δnitrogen removal rate=[(max. nitrogen removal rate−min. nitrogen removal rate)/min. nitrogen removal rate]*100%;

Δcarbon residue removal rate=[(max. carbon residue removal rate−min. carbon residue removal rate)/min. carbon residue removal rate]*100%;

Δmetal removal rate=[(max. metal removal rate−min. metal removal rate)/min. metal removal rate]*100%;

wherein the terms "max." and "min." refer to the maximum and minimum values in each batch.

In a preferable embodiment, "the property of the hydrogenated residual oil being substantially kept at a constant level" refers to Δsulfur removal rate of <20%; Δnitrogen removal rate of <40%; Δcarbon residue removal rate of <40%; and Δmetal removal rate of <20%. In the most preferable embodiment, "the property of the hydrogenated residual oil being substantially kept at a constant level" refers to Δsulfur removal rate of <10%; Δnitrogen removal rate of <20%; Δcarbon residue removal rate of <20%; and Δmetal removal rate of <10%.

If the property of the hydrogenated residual oil undesirably changes (for example, the density increases or the carbon residue content increases), the severity of the hydrogenation reaction is increased so that the property of the hydrogenated residual oil is substantially kept at the same constant level as the property of the hydrogenated residual oil at the early stage. For example, if the density of the hydrogenated residual oil increases by 0.001-0.005 g/cm$^3$, or the carbon residue content of the hydrogenated residual oil increases by 0.1%-0.5%, the reaction severity of the hydrogenation reaction is increased. Again for example, when the increasing rate for the density of the hydrogenated residual oil is above 0.005 g/cm$^3$/(1000 hrs), and/or when the increasing rate for the carbon residue content of the hydrogenated residual oil is above 0.5 wt %/(1000 hrs), the severity of the hydrogenation reaction is increased, for example, the reaction temperature is increased at 2-10° C./(1000 hrs) or the liquid hourly space velocity is decreased at 0.1-0.5 h$^{-1}$/(1000 hrs).

The low severity hydrogenation reaction can be operated in such a manner that the reaction temperature is controlled along the time in the whole reaction period. For example, the reaction temperature is increased at a constant speed (the temperature increasing rate is 10-50° C./(8000 hrs)), or the whole operation period is averagely divided into n stages (n is an integer of more than 1), the reaction temperature is kept at a constant temperature in each stage, and the temperature difference between any two successive stages (the reaction temperature at the end of the latter stage minus the reaction temperature at the end of the former stage) is 10-50° C./(n−1); wherein the reaction temperature of the low severity hydrogenation reaction is 350-370° C. during the operation period of 0-1000 hour.

In the present invention, unless otherwise specified, for the hydrogenation reaction, the reaction temperature means the average temperature of the reactor, and for the catalytic cracking reaction, the reaction temperature means the outlet temperature of the reactor.

The inventors of the present invention have unexpectedly discovered that, for the hydrogenation reaction of inferior feedstock oil, if the yield of the hydrogenated residual oil is controlled to 85%-95% by weight, the increase of the deposition amount of metal and coke on the catalyst becomes slower and slower along with the increased operation time of the reaction unit, and the operation period of the residual oil hydrogenation reaction unit can increase remarkably. In the present invention, this kind of hydrogenation reaction is called as the low severity hydrogenation reaction. According to the present invention, the inferior feedstock oil is subjected to an adjustable low severity hydrogenation reaction in a low severity hydrogenation unit. By dynamically adjusting the reaction conditions, the yield of the hydrogenated residual oil obtained through product separation and fractionation and the impurity removal rate are relatively stable. Specifically speaking, along with the increased unit operation time, when the yield of the hydrogenated residual oil increases and the impurity removal rate decreases, the severity of the hydrogenation reaction will be increased (for example, the reaction temperature will be increased).

Overall, the reaction conditions of the low severity hydrogenation reaction can comprise: the hydrogen partial pressure is 8-20 MPa, preferably 9-16 MPa, the reaction temperature is 330-420° C., preferably is 350° C.-400° C., the liquid hourly space velocity is 0.1-1.5 preferably 0.2-1.0 and the total hydrogen/oil volume ratio is 200-1500 normal m$^3$/m$^3$, preferably 500-1000 normal m$^3$/m$^3$, wherein the reaction temperature of the low severity hydrogenation reaction in the early operation (for example, 0-1000 hour) is 350-370° C.

The main object of using the low severity hydrogenation reaction lies in controlling the sulfur removal rate, the nitrogen removal rate, the carbon residue removal rate and the metal removal rate of the inferior feedstock oil at lower levels. Specifically, the sulfur removal rate of the inferior feedstock oil can be controlled to 50-95 wt %, preferably 65-85 wt %, the nitrogen removal rate can be controlled to 10-70 wt %, preferably 25-45 wt %, the carbon residue removal rate can be controlled to 10-70 wt %, preferably 25-45 wt %, and the metal removal rate can be controlled to 50-95 wt %, preferably 65-80 wt %.

According to the present invention, the low severity hydrogenation reaction is conducted in a fixed bed reactor. According to the present invention, the low severity hydrogenation reaction is conducted in presence of the hydrogenation catalyst. According to the function of the hydrogenation catalyst, in the flow direction of reactants, the hydrogenation catalyst for the low severity hydrogenation reaction can successively comprise a hydrogenation protecting catalyst, a hydrodemetallization catalyst, a hydrodesulfurization catalyst, and a hydrodenitrogenation and carbon residue removing catalyst. Preferably, based on the total weight of the hydrogenation catalyst, the hydrogenation protecting catalyst and the hydrodemetallization catalyst comprise 20%-70%, for example, 30%-50%; the hydrodesulfurization catalyst comprises 20%-70%, for example, 40%-60%; the hydrodenitrogenation and carbon residue removing catalyst comprises 0%-60%, for example, 10%-40%, and the total of the hydrogenation protecting catalyst, the hydrodemetallization catalyst, the hydrodesulfurization catalyst, and the hydrodenitrogenation and carbon residue removing catalyst is 100 wt %. The hydrogenation catalysts are those conventionally used in the art. In a preferable embodiment, based on the total weight of the hydrogenation catalyst, the hydrodemetallization catalyst comprises 30 wt % or higher.

According to the present invention, the inferior feedstock oil is that conventionally used in the art. For example, the inferior feedstock oil can be petroleum hydrocarbons and/or other mineral oils, wherein the petroleum hydrocarbons can be selected from atmospheric gas oil, vacuum gas oil, atmospheric residual oil, vacuum residual oil, hydrogenated residual oil, coker gas oil, deasphalted oil, and any combination thereof, and the other mineral oil can be selected from liquefied oil derived from coal or natural gas, tar sand oil, tight oil, shale oil, and any combination thereof.

From the aspect of properties, the inferior feedstock oil can satisfy: (1) the density at 20° C. is 910-1000 kg/m$^3$; and/or (2) the weight percent of carbon residue is 4-15 wt %; and/or (3) the content of metals (Ni+V) is 12-600 ppm. Preferably, the inferior feedstock oil satisfies: (1) the density at 20° C. is 980-1000 kg/m$^3$; and/or (2) the weight percent of carbon residue is 10-15 wt %; and/or (3) the content of metals (Ni+V) is 60-600 ppm.

According to the present invention, said first catalytic cracking reaction is a high selectivity catalytic cracking process, which does not pursue a highest one-through conversion of the feedstock oil, but controls the conversion at an appropriate level so as to effectively reduce the production of dry gas and coke and simultaneously produce a larger amount of the FGO for a further hydrogenation. The present process can effectively remedy the insufficient processing depth of the inferior feedstock in the low severity residual oil hydrogenation and can optimize the product distribution.

The first catalytic cracking reaction can comprise the following steps: (1) a preheated hydrogenated residual oil and a first regenerated catalytic cracking catalyst are subjected to a first cracking reaction in the lower part of the first catalytic cracking reactor, the resultant reaction product is separated to produce a first cracking product and a first semi-regenerated catalytic cracking catalyst; the micro-activity of the first regenerated catalytic cracking catalyst is 35-60; (2) the first cracking product and the first semi-regenerated catalytic cracking catalyst obtained in step (1) are then subjected to a first further catalytic conversion reaction in the upper part of the first catalytic cracking reactor, and the resultant reaction product is separated by fractionation to produce the first dry gas, the first LPG the first gasoline, the first diesel and the first FGO. The upper and lower parts of the first catalytic cracking reactor are demarcated by a certain position between the first ⅓ part and the first ⅔ part of the reactor (in the flowing direction of reactants). In a preferable embodiment, the lower part refers to the first half of the reactor length, while the upper part refers to the second half of the reactor length. The first cracking reaction mainly comprises the cracking reactions of large molecules, and the first further catalytic conversion reaction mainly comprises selective cracking, selective hydrogen transfer, isomerization and the like. The first cracking reaction can be conducted in the following conditions: the reaction temperature is 530-620° C., the weight hourly space velocity is 30–180 h$^{-1}$, the catalyst/oil ratio (the weight ratio of catalyst to feedstock oil) is 4-12, the steam/oil ratio (the weight ratio of water vapor to feedstock oil) is 0.03-0.3, and the reaction pressure is 130 kPa-450 kPa. The first further catalytic conversion reaction is conducted in the following conditions: the reaction temperature is 460° C.–520° C., the weight hourly space velocity is 20-100 h$^{-1}$, the catalyst/oil ratio is 3-15, the steam/oil ratio (the weight ratio of water vapor to feedstock oil) is 0.03-0.3, and the reaction pressure is 130 kPa-450 kPa. In the first catalytic cracking reaction, the first FGO has a hydrogen content of 10.5-15 wt %; based on the hydrogenated residual oil, the yield of the first FGO is 15-50 wt %, preferably 30-45 wt %.

According to the present invention, a second-processed gas oil and the first FGO can be subjected together to the hydrogenation reaction of gas oil of step c) to increase the feedstock source for the second catalytic cracking. The second-processed gas oil can be selected from coker gas oil, deasphalted oil, FGO produced by other FCC units, and any combination thereof. The FGO is not limited to the first FGO and the second FGO of the present invention, and can be from other FCC units.

According to the present invention, the hydrogenation reaction of gas oil can be conducted in the following conditions: the reaction pressure can be 5.0-20.0 MPa, preferably 6.0-15.0 MPa, the reaction temperature can be 300-430° C., preferably 320-390° C., the liquid hourly space velocity can be 0.2-5.0 h$^{-1}$, preferably 0.3-2.5 h$^{-1}$, the hydrogen/oil volume ratio can be 200-1800 normal m$^3$/m$^3$, preferably 400-1100 normal m$^3$/m$^3$.

The hydrogenation reaction of gas oil is conducted in a fixed bed reactor in presence of a hydrogenation catalyst. According to the function of the hydrogenation catalyst, in the flow direction of reactants, the hydrogenation catalyst for the hydrogenation reaction of gas oil can successively comprise a hydrogenation protecting catalyst, a hydrodemetallization and a hydrodesulfurization catalyst and a hydrotreatment catalyst. Preferably, based on the total weight of the hydrogenation catalyst, the hydrogenation protecting catalyst comprises 0-30 wt %, for example, 5-20 wt %, the hydrodemetallization and hydrodesulfurization catalyst comprises 5-35 wt %, for example, 10-25 wt %; and the hydrotreatment catalyst comprises 35%-95 wt %, for example, 55-85 wt %, and the total of the hydrogenation protecting catalyst, the hydrodemetallization and hydrodesulfurization catalyst and the hydrotreatment catalyst is 100 wt %. The hydrogenation catalysts are those conventionally used in the art.

According to the present invention, the second catalytic cracking reaction can be conducted in conditions which are conventional in the art, for example, the reaction temperature is 450° C.-620° C., the weight hourly space velocity is 1-100 $h^{-1}$, the catalyst/oil ratio is 1-25, and the steam/oil ratio is 0.03-0.3. The second catalytic cracking reaction can be also conducted through a high selectivity catalytic cracking process, for example, the second catalytic cracking reaction can comprise the following steps: (1) a preheated hydrogenated gas oil and a second regenerated catalytic cracking catalyst are subjected to a second cracking reaction in the lower part of a second catalytic cracking reactor, the resultant reaction product is separated to produce a second cracking product and a second semi-regenerated catalytic cracking catalyst; (2) the second cracking product obtained in step (1) and the second semi-regenerated catalytic cracking catalyst are then subjected to a second further catalytic conversion reaction in the upper part of the second catalytic cracking reactor, and the resultant reaction product is separated by fractionation to produce a second dry gas, a second LPG a second gasoline, a second diesel and a second FGO. The upper and lower parts of the second catalytic cracking reactor are demarcated by a certain position between the first ⅓ part and the first ⅔ part of the reactor (in the flowing direction of reactants). In a preferable embodiment, the lower part refers to the first half of the reactor length, while the upper part refers to the second half of the reactor length.

It should be noted that, the hydrogenation catalyst, the catalytic cracking catalyst, the hydrogenation reactor and the catalytic cracking reactor used in the process of the present invention can be those conventionally used in the art. The hydrogenation catalyst can contain at least one metal component selected from the VIII group and/or at least one metal component selected from the VIB group (as active component), and alumina and/or silica (as support). The catalytic cracking catalyst can contain zeolite (as active component), preferably mesoporous zeolite and/or optionally large pore zeolite; wherein the mesoporous zeolite can be selected from ZSM series and/or ZRP series. The catalytic cracking reactor can be selected from a riser, a fluidized bed, and combinations thereof. The hydrogenation reactor can be selected from a fixed bed, a slurry bed, a ebullated bed, a moving bed, and combinations thereof (preferably a fixed bed). The number of the catalytic cracking reactor and the hydrogenation reactor can be respectively 1, 2, 3 or more. When the number of the reactor is 2, the reactors may be connected in series or in parallel; when the number of the reactor is 3 or more, the reactors can be connected in series, in parallel, or in series-parallel hybrid.

A specific embodiment of the present invention will be provided below with reference to the accompanying drawings.

An inferior feedstock oil from pipeline 9 and a mixed gas of a fresh hydrogen and a recycled hydrogen from pipeline 11 are mixed and sent to a low severity hydrogenation reactor 1 to conduct an impurity removal, a hydrodemetallization, a hydrodesulfurization, a hydrodenitrogenation and a hydrogenation-carbon residue removal in a low severity hydrogenation reaction condition. The resultant product is sent via pipeline 13 to a separation unit 2 for the low severity hydrogenation reaction product. The hydrogen-rich gas stream is sent via pipeline 14 to a recycle gas treatment system 3, via pipeline 15 to a recycled hydrogen compressor 4, then via pipeline 16 to be mixed with a fresh hydrogen from pipeline 10. The liquid stream from the separation unit 2 is sent via pipeline 17 to a hydrogenation fractionation unit 5 to produce respectively, a hydrogenated gas (pipeline 18), a hydrogenated naphtha (pipeline 19), a hydrogenated diesel (pipeline 20) and a hydrogenated residual oil (pipeline 21). The hydrogenated residual oil is sent via pipeline 21 to a first catalytic cracking reactor 6 to conduct a reaction under a high selectivity catalytic cracking reaction condition, and successively produce, after separation and fractionation, a first dry gas (pipeline 25), a first LPG (pipeline 26), a first gasoline (pipeline 27), a first light cycle oil (pipeline 28), a first FGO (pipeline 29) and a slurry oil (pipeline 30). The slurry oil is sent via pipeline 30 with a slurry oil pump to a first catalytic cracking reactor 6 for a further reaction.

The first FGO is mixed via pipeline 29 with a mixed hydrogen from pipeline 12, and sent to a hydrogenation reactor 7 of gas oil. The stream leaving the hydrogenation reactor 7 of gas oil is separated in a separation unit 8 of the FGO hydrogenation product. The resultant hydrogen-rich gas stream is mixed via pipeline 23 with the hydrogen-rich gas stream from pipeline 14 and the mixture is sent to the recycle gas treatment system 3. The resultant liquid stream (hydrogenated gas oil) is mixed via pipeline 24 and the hydrogenated residual oil from pipeline 21 and the mixture is sent to the first catalytic cracking reactor 6.

The present invention will be further illustrated by the following examples, but the present invention is not limited thereto.

The instruments, devices and reagents used in the examples of the present invention are those conventionally used in the art unless otherwise specified.

The analytical methods used in the examples are as follows:

| | |
|---|---|
| Metal (Ni + V) content | Petrochemical analytic method RIPP 124-90 |
| Sulfur content | Petrochemical analytic method RIPP 62-90 |
| Nitrogen content | Petrochemical analytic method RIPP63-90 |
| Carbon residue content | Petrochemical analytic method RIPP148-90 |

The above methods are described in Petrochemical analytic method (RIPP test method), Yang Cuiding et al, Science Press, 1990.

According to the following formula, the removal rates for sulfur, carbon residue, nitrogen and metal are respectively calculated:

$$\text{Removal rate} = \left(1 - \frac{\text{Impurity content in the product oil}}{\text{Impurity content in the feedstock}}\right) \times 100\%$$

The inferior feedstock oil used in Examples and Comparative Examples is a mixed residual oil of a vacuum residual oil and an atmospheric residual oil, and its properties are listed in Table 1.

TABLE 1

| Properties of the inferior feedstock oil | |
|---|---|
| Feedstock | |
| Density (20° C.), g/cm$^3$ | 0.996 |
| kinematic viscosity (100° C.), mm$^2$/s | 162.5 |
| C, wt % | 82.68 |
| H, wt % | 10.45 |
| S, wt % | 4.36 |
| N, wt % | 0.20 |

TABLE 1-continued

| Properties of the inferior feedstock oil | |
|---|---|
| Feedstock | |
| Carbon residue content, wt % | 13.5 |
| Metal (Ni + V), ppm | 94.9 |
| Saturates, wt % | 23.6 |
| Aromatics, wt % | 47.2 |
| Resins, wt % | 23.6 |
| Asphaltenes (C7 insoluble), wt % | 5.6 |

The catalysts used in Examples and Comparative Examples are produced by SINOPEC Catalyst Company.

Example 1

Example 1 provided an adjustable low severity hydrogenation reaction according to the present invention. The reaction temperature and the liquid hourly space velocity were adjusted along with the reaction time in stages, and the hydrogen/oil volume ratio and the hydrogen partial pressure were maintained at 800 normal $m^3/m^3$ and 15 MPa respectively. For the hydrogenated product of the inferior feedstock oil, the cutting point of hydrogenated residual oil was set at 350° C.

The hydrogenation test was conducted in a continuous high-pressure fixed-bed pilot device, which comprised three reactors connected in series, each containing a hydrogenation protecting catalyst (RG-10A), a hydrodemetallization catalyst (RDM-2B), and a hydrodesulfurization catalyst (RMS-1B) in a volume ratio of 5:45:50. At the time of the test, the pilot device was in its initial operation and its operating time was less than 50 hours.

The catalytic cracking test was conducted in a middle-size FCC device, using a riser reactor and an MLC-500 catalyst.

The hydrogenation test of FGO was conducted in a fixed-bed hydrogenation reactor, which fixed-bed hydrogenation reactor was loaded with a hydrogenation protecting catalyst A (RG-30A), a hydrogenation protecting catalyst B (RG-30B), a hydrodemetallization and hydrodesulfurization catalyst (RMS-30) and a hydrotreatment catalyst (RDA-1) in a volume ratio of 4:4:15:77.

Comparative Example 1

Comparative Example 1 was a conventional residual oil hydrogenation test. The test devices and the test feedstock were identical to those in Example 1. The difference from Example 1 lay in the temperature and the liquid hourly space velocity of the hydrogenation reaction of the inferior feedstock oil were respectively set at constant values of 390° C. and 0.25 $h^{-1}$.

The reaction condition and the reaction result of Example 1 and Comparative Example 1 were listed in Table 2.

Example 2

The reaction product obtained from the $5000^{th}$-$5500^{th}$ hour of the reaction of Example 1 (see Table 3) was selected as the object in the subsequent study. The hydrogenated residual oil was used as the feedstock of the first catalytic cracking reaction. The hydrogenated residual oil was subjected to the first catalytic cracking reaction and the separation and fractionation to produce the first dry gas, the first LPG the first gasoline, the first diesel and the first FGO. The cutting point of the first FGO was set at 330° C., and comprised 33.23 wt % of the feedstock. The first FGO was sent to the FGO hydrogenation unit, the resultant product was subjected to a gas-liquid separation. The hydrogenated gas oil as the liquid stream was subjected to the second catalytic cracking reaction to produce the second dry gas, the second LPG the second gasoline, the second diesel and the second FGO. The second FGO was sent to the FGO hydrogenation unit. The operation conditions were listed in Table 4, and the product distribution was listed in Table 5.

Comparative Example 2

Comparative Example 2 was a combination of the existing residual oil hydrogenation-heavy oil catalytic cracking. The reaction product obtained from the $5000^{th}$-$5500^{th}$ hour of the reaction of Comparative Example 1 (see Table 3) was selected as the object in the subsequent study. The hydrogenated residual oil was subjected to the reaction and the separation and fractionation to produce the dry gas, the LPG, the gasoline, the diesel, the slurry oil and the coke. The operation conditions were listed in Table 4, and the product distribution was listed in Table 5.

Comparative Example 3

The reaction procedure and the reaction condition of Comparative Example 3 were substantially identical to those of Example 2, except that in Comparative Example 3, the reaction product obtained from the $5000^{th}$-$5500^{th}$ hour of the reaction of Comparative Example 1 (see Table 3) was selected as the object in the subsequent study. The operation conditions were listed in Table 4, and the product distribution was listed in Table 5.

TABLE 2

| | Example 2 | | | | Comparative Example 2 | | | |
|---|---|---|---|---|---|---|---|---|
| | Reaction time, 1000 h | | | | | | | |
| | 0-2 | 2-4 | 4-6 | 6-8 | 0-2 | 2-4 | 4-6 | 6-8 |
| Reaction temperature, ° C. | 360 | 370 | 380 | 390 | 390 | | | |
| Liquid hourly space velocity, $h^{-1}$ | 0.35 | 0.3 | 0.25 | 0.2 | 0.25 | | | |
| hydrogen/oil volume ratio, normal $m^3/m^3$ | 800 | | | | 800 | | | |
| Hydrogen partial pressure, MPa | 15 | | | | 15 | | | |
| Average residual oil yield, wt % | 87.96 | 89.15 | 90.38 | 92.03 | 78.64 | 84.12 | 90.65 | 94.11 |
| Average impurity removal rate, % | | | | | | | | |
| sulfur removal rate | 85.23 | 85.86 | 85.75 | 84.69 | 95.63 | 92.27 | 85.36 | 70.65 |
| nitrogen removal rate | 33.46 | 35.65 | 35.79 | 31.05 | 62.89 | 58.12 | 50.12 | 31.02 |
| carbon residue removal rate | 38.25 | 40.21 | 39.76 | 39.02 | 68.96 | 60.11 | 51.23 | 32.18 |
| metal removal rate | 77.65 | 78.87 | 78.98 | 75.33 | 91.69 | 88.78 | 80.29 | 67.31 |
| Cumulative operating time, 1000 h | 8 | | | | 8 | | | |

TABLE 3

Properties and product distributions for parts of hydrogenated residual oils obtained in Example 1 and Comparative Example 1 (the resultant hydrogenated residual oil of Example 1 was used in Example 2 and the resultant hydrogenated residual oil of Comparative Example 1 was used in Comparative Example 2 and Comparative Example 3)

| Item | Example 1 | Comparative Example 1 |
|---|---|---|
| Reaction condition | | |
| Reaction temperature, ° C. | 380 | 390 |
| Liquid hourly space velocity, $h^{-1}$ | 0.25 | 0.25 |
| Hydrogen/oil volume ratio, v/v | 800 | 800 |
| Hydrogen partial pressure, MPa | 15.0 | 15.0 |
| Hydrogen consumption | 1.75 | 2.03 |
| Property of hydrogenated residual oil (cutting point > 350° C.) | | |
| Density (20° C.), g/cm$^3$ | 0.944 | 0.936 |
| S, wt % | 0.62 | 0.43 |
| N, wt % | 0.13 | 0.12 |
| Carbon residue, wt % | 8.1 | 6.2 |
| Metal (Ni + V), ppm | 20.0 | 17.8 |
| Product distribution, wt % | | |
| Gas | 3.75 | 5.92 |
| Hydrogenated naphtha | 1.98 | 2.87 |
| Hydrogenated diesel | 7.46 | 11.95 |
| Hydrogenated residual oil | 88.56 | 81.29 |
| Total | 101.75 | 102.03 |
| Operation period/month | 16 | 12 |

TABLE 4

Reaction condition for Example 2, Comparative Example 2 and Comparative Example 3

| | Example 2 | Comparative Example 2 | Comparative Example 3 |
|---|---|---|---|
| Source for hydrogenated residual oil | Example 1 | Comparative Example 1 | Comparative Example 1 |
| First catalytic cracking | | | |
| Catalyst | MLC-500 | MLC-500 | MLC-500 |
| Operation condition | | | |
| Riser outlet temperature, ° C. | 500 | 500 | 500 |
| Temperature of reaction zone I/II, ° C. | 600/500 | / | 600/500 |
| Weight hourly space velocity or Reaction time of reaction zone I/II, $h^{-1}$ or second | 100/30 | 2.3 | 100/30 |
| Catalyst/oil ratio | 6 | 6 | 6 |
| Steam/oil ratio | 0.05 | 0.05 | 0.05 |
| Percent of FGO (cutting point > 330° C.) relative to feedstock, wt % | 33.23 | / | 27.02 |
| FGO hydrogenation | | | |
| Hydrogen partial pressure, MPa | 13.0 | / | 13.0 |
| Reaction temperature, ° C. | 370 | / | 370 |
| Liquid hourly space velocity, $h^{-1}$ | 0.4 | / | 0.4 |
| Hydrogen/oil volume ratio, v/v | 600 | / | 600 |
| Second catalytic cracking | | | |
| Catalyst | MLC-500 | / | MLC-500 |
| Operation condition | | | |
| Riser outlet temperature, ° C. | 500 | / | 500 |
| Temperature of reaction zone I/II, ° C. | 600/500 | / | 600/500 |
| Weight hourly space velocity or Reaction time of reaction zone I/II, $h^{-1}$ or second | 100/20 | / | 100/20 |
| Catalyst/oil ratio | 6 | / | 6 |
| Steam/oil ratio | 0.05 | / | 0.05 |

TABLE 5

The reaction results for Example 2, Comparative Example 2 and Comparative Example 3.

| | Item | | | | | | | |
|---|---|---|---|---|---|---|---|---|
| | Example 2 | | | Comparative Example 2 | | Comparative Example 3 | | |
| | Chemical hydrogen consumption | | | | | | | |
| | 1.75 | | | 2.03 | | 2.03 | | |
| | Product distribution, % | | | | | | | |
| | First catalytic cracking (hydrogenated residual oil) | Second catalytic cracking (hydrogenated gas oil) | Complete process* | Catalytic cracking (hydrogenated residual oil) | Complete process* | First catalytic cracking | Second catalytic cracking | Complete process* |
| Dry gas | 2.06 | 1.53 | 2.57 | 3.6 | 3.6 | 2.05 | 1.49 | 2.45 |
| LPG | 13.5 | 15.98 | 18.81 | 15.65 | 15.65 | 14.46 | 16.03 | 18.79 |
| Gasoline | 30.94 | 55.93 | 49.53 | 40.2 | 40.2 | 31.56 | 55.32 | 46.51 |
| Diesel | 13.05 | 17.96 | 19.02 | 24.3 | 24.3 | 17.86 | 17.42 | 22.57 |
| FGO (cutting point > 330° C.) | 33.23 | 5.58 | 1.85 | | | 27.02 | 6.76 | 1.83 |
| Slurry oil | | | | 6.7 | 6.7 | | | |
| Coke | 7.22 | 3.02 | 8.22 | 9.55 | 9.55 | 7.05 | 2.98 | 7.86 |
| Total liquid yield | | | 87.35 | | 80.15 | | | 87.87 |
| Total | 100 | 100 | 100.00 | 100 | 100 | 100 | 100 | 100.00 |

*Calculated based on the hydrogenated residual oil feedstock being 100%

The invention claimed is:

1. A process for converting inferior feedstock oil, comprising:

a) feeding an inferior feedstock oil into a hydrogenation reactor to conduct a hydrogenation reaction, separating an effluent from the hydrogenation reactor to obtain a hydrogenated gas, a hydrogenated naphtha, a hydrogenated diesel, and a hydrogenated residual oil, wherein, in the hydrogenation reactor, based on the inferior feedstock oil, a yield of the hydrogenated residual oil is 85%-95% by weight;

b) feeding the hydrogenated residual oil obtained in step a) to a first catalytic cracking reactor, separating an effluent from the first catalytic cracking reactor to obtain a first dry gas, a first LPG, a first gasoline, a first diesel, and a first FCC-gas oil;

c) feeding the first FCC-gas oil obtained in step b) to a gas oil hydrogenation reactor, separating an effluent from the gas oil hydrogenation reactor to obtain a hydrogenated gas oil;

d) feeding the hydrogenated gas oil obtained in step c) to the first catalytic cracking reactor or a second catalytic cracking reactor; and e) monitoring a density or a carbon residue content of the hydrogenated residual oil and increasing a reaction severity of the hydrogenation reaction when the density, the carbon residue content, or both, increases, wherein the hydrogenation of the inferior feedstock oil in step a) is carried out with a variation percent of sulfur removal rate of less than 40%, a variation percent of metal removal rate of less than 20%, a variation percent of nitrogen removal rate of less than 40%, and/or a variation percent of carbon residue removal rate of less than 40% for at 8000 hrs on stream time, and wherein the hydrogenation of the FCC-gas oil in step b) is carried out in presence of a hydrogenation catalyst comprising 5-20 wt % of hydrogenation protecting catalyst, 5-35 wt % hydrodemetallization and hydrodesulfurization catalyst, and 55-85 wt % hydrotreatment catalyst.

2. The process according to claim 1, wherein the process further comprises step e) obtaining a second FCC-gas oil from the second catalytic cracking reactor; and step d) feeding the second FCC-gas oil to the gas oil hydrogenation reactor.

3. The process according to claim 1, wherein when the density of the hydrogenated residual oil increases by 0.001-0.005 g/cm$^3$, or the carbon residue content of the hydrogenated residual oil increases by 0.1%-0.5%, increasing the reaction severity in the hydrogenation reaction.

4. The process according to claim 1, when a density of the hydrogenated residual oil increases by more than 0.005 g/cm$^3$ every 1000 hrs, and/or when a carbon residue content of the hydrogenated residual oil increases by more than 0.5 wt % every 1000 hrs, increasing the reaction severity in the hydrogenation reactor.

5. The process according to claim 1, wherein the inferior feedstock oil is a petroleum hydrocarbon, a mineral oil, or a mixture thereof, wherein the petroleum hydrocarbon is selected from the group consisting of atmospheric gas oil, vacuum gas oil, atmospheric residual oil, vacuum residual oil, hydrogenated residual oil, coker gas oil, deasphalted oil, and mixtures thereof, and the mineral oil is selected from the group consisting of liquefied oil derived from coal or natural gas, tar sand oil, tight oil, shale oil, and mixtures thereof.

6. The process according to claim 1, wherein the inferior feedstock oil has a density at 20° C. of 980-1000 kg/m$^3$, a weight percent of carbon residue of 10-15 wt %, and/or a content of metals (Ni+V) of 60-600 ppm.

7. The process according to claim 1, wherein step b) further comprising:

(1) subjecting the hydrogenated residual oil to a first cracking reaction by contacting the hydrogenated residual oil and a first regenerated catalytic cracking catalyst in a lower reaction zone in the first catalytic cracking reactor to obtain a first cracking product and a first semi-regenerated catalytic cracking catalyst; and (2) subjecting the first cracking product and the first semi-regenerated catalytic cracking catalyst obtained in step (1) to a first further catalytic conversion reaction in an upper reaction zone of the first catalytic cracking reactor to produce the effluent from the first catalytic reactor.

8. The process according to claim 7, wherein the first cracking reaction in the lower reaction zone has a reaction temperature of 530-620° C., a weight hourly space velocity of 30-180 h$^{-1}$, a catalyst/oil ratio of 4-12, a steam/oil ratio of 0.03-0.3, and a reaction pressure of 130 kPa-450 kPa; and wherein the first further catalytic conversion reaction in the upper reaction zone has a reaction temperature of 460° C.–520° C., a weight hourly space velocity of 20-100 h$^{-1}$, a catalyst/oil ratio of 3-15, a steam/oil ratio of 0.03-0.3, and a reaction pressure of 130 kPa-450 kPa.

9. The process according to claim 1, wherein a hydrogen content of the first FCC-gas oil is 10.5-15 wt % and, based on the hydrogenated residual oil, a yield of the first FCC-gas oil is 15%-50% by weight.

10. The process according to claim 1, further comprising feeding a second-processed gas oil to the gas oil hydrogenation reactor, and the second-processed gas oil is selected from the group consisting of coker gas oil, deasphalted oil, FCC-gas oil produced by other FCC units, and combinations thereof.

11. The process according to claim 1, wherein the gas oil hydrogenation reactor is a fixed bed reactor containing a hydrogenation catalyst.

12. The process according to claim 1, wherein the gas oil hydrogenation reactor has a reaction pressure of 5.0-20.0 MPa, a reaction temperature of 300-430° C., a liquid hourly space velocity of 0.2-5.0 h$^{-1}$, and a hydrogen/oil volume ratio of 200-1800 normal m$^3$/m$^3$.

13. The process according to claim 1, wherein the second catalytic cracking reactor has a reaction temperature of 450° C.–620° C., a weight hourly space velocity of 1-100 h$^{-1}$, a catalyst/oil ratio of 1-25, and a steam/oil ratio of 0.03-0.3.

14. The process according to claim 1, wherein, in the second catalytic cracking reactor, the hydrogenated gas oil and a second regenerated catalytic cracking catalyst are subjected to a second cracking reaction in a lower zone of the second catalytic cracking reactor to obtain a second cracking product and a second semi-regenerated catalytic cracking catalyst; and the second cracking product and the second semi-regenerated catalytic cracking catalyst are then subjected to a second further catalytic conversion reaction in an upper reaction zone of the second catalytic cracking reactor, and an effluent from the second catalytic cracking reactor is separated by fractionation to produce a second dry gas, a second LPG, a second gasoline, a second diesel and a second FCC-gas oil.

15. The process according to claim 1, wherein an initial reaction temperature in the hydrogenation reactor is 350-370° C.

16. The process according to claim 1, wherein, in step a), the effluent from the hydrogenation reactor is separated into a hydrogen-rich gas and a liquid, and the liquid is further separated to obtain the hydrogenated gas, the hydrogenated naphtha, the hydrogenated diesel, and the hydrogenated residual oil.

17. The process according to claim 16, further comprising feeding the hydrogen rich gas and a fresh hydrogen into the hydrogenation reactor.

18. The process according to claim 1, wherein the liquid hourly space velocity in the hydrogenation reactor is in a range of 0.2-0.35 $h^{-1}$.

19. The process according to claim 3, wherein the reaction severity in the hydrogenation reactor is increased by increasing the reaction temperature at a rate of 2-10° C./(1000 hrs) or decreasing the liquid hourly space velocity at a rate of 0.1-0.5 $h^{-1}$/(1000 hrs).

* * * * *